United States Patent [19]

Vodarich

[11] 4,256,023

[45] Mar. 17, 1981

[54] BAG MAKING APPARATUS

[76] Inventor: Umberto Vodarich, Myrtleford Rd., Murmungee, 3747, Victoria, Australia

[21] Appl. No.: 10,825

[22] Filed: Feb. 9, 1979

[30] Foreign Application Priority Data

Feb. 10, 1978 [AU] Australia ..... 3340/78

[51] Int. Cl.[3] ..... B31B 1/56; B31B 21/60

[52] U.S. Cl. ..... 493/266; 93/22

[58] Field of Search ..... 93/27, 26, 21, 22, 14, 93/18, 8 R; 270/72, 75, 83

[56] References Cited

U.S. PATENT DOCUMENTS

| | | | |
|---|---|---|---|
| 340,080 | 4/1886 | Appel | 93/27 |
| 2,013,672 | 9/1935 | Royal | 93/27 X |
| 2,041,301 | 5/1936 | Scholl et al. | 93/27 |
| 2,268,921 | 1/1942 | Bischoff et al. | 93/27 |

*Primary Examiner*—James F. Coan

*Attorney, Agent, or Firm*—Andrus, Sceales, Starke & Sawall

[57] ABSTRACT

The present invention provides a bag making apparatus comprising a first and a second pair of abutments, wherein the abutments of each said pair of abutments are co-operable to grip therebetween a part of a sleeve of bag material to be formed into a bag and adhesive applicator means and constructed and arranged whereby, in use, a first portion of a sleeve of bag material to be formed into a bag is gripped adjacent one end by said first pair of abutments, adhesive is applied to said sleeve, said one end is caused to overly a second portion of said sleeve to form a bag having a first fold and which first fold being stabilized by adhesive, a third portion of the bag so formed adjacent the end defined by said first fold is gripped by said second pair of abutments adhesive is applied to the bag, and said end defined by said first fold is caused to overly a fourth portion of the bag so formed to form a second fold and which second fold being stabilized by adhesive.

11 Claims, 6 Drawing Figures

BAG MAKING APPARATUS

FIELD OF THE INVENTION

This invention relates to bag making apparatus and to a method.

SUMMARY OF THE INVENTION

The present invention provides a bag making apparatus comprising a first and a second pair of abutments, wherein the abutments of each said pair of abutments are co-operable to grip therebetween a part of a sleeve of bag material to be formed into a bag, and adhesive applicator means; and constructed and arranged whereby, in use, a first portion of a sleeve of bag material to be formed into a bag is gripped adjacent one end by said first of abutments, adhesive is applied to said sleeve, said one end is caused to overly a second portion of said sleeve to form a bag having a first fold and which first fold being stabilized by adhesive, a third portion of the bag so formed adjacent the end defined by said first fold is gripped by said second pair of abutments, adhesive is applied to the bag, and said end defined by said first fold is caused to overly a fourth portion of the bag so formed to form a second fold and which second fold being stabilized by adhesive.

PREFERRED ASPECTS OF THE INVENTION

Said third portion preferably is part of the bag so formed included in the first fold.

The apparatus preferably includes means for positively inserting the relevant portions between the abutments of the pairs of abutments.

The pairs of abutments are preferably revolved about an axis. It is also preferred that one abutment of each pair is controlled by cam means to move towards, to grip, and away from, to release, the other abutment of each pair of abutments.

Said means for positively inserting and said adhesive applicator means are preferably caused to revolve about an axis in synchronism with the revolution of the pairs of abutments about their axis.

A specific construction in accordance with this invention will now be described by way of non-limiting example thereof with the aid of the accompanying drawings.

DETAILED DESCRIPTION WITH RESPECT TO THE DRAWINGS

Figure 1:
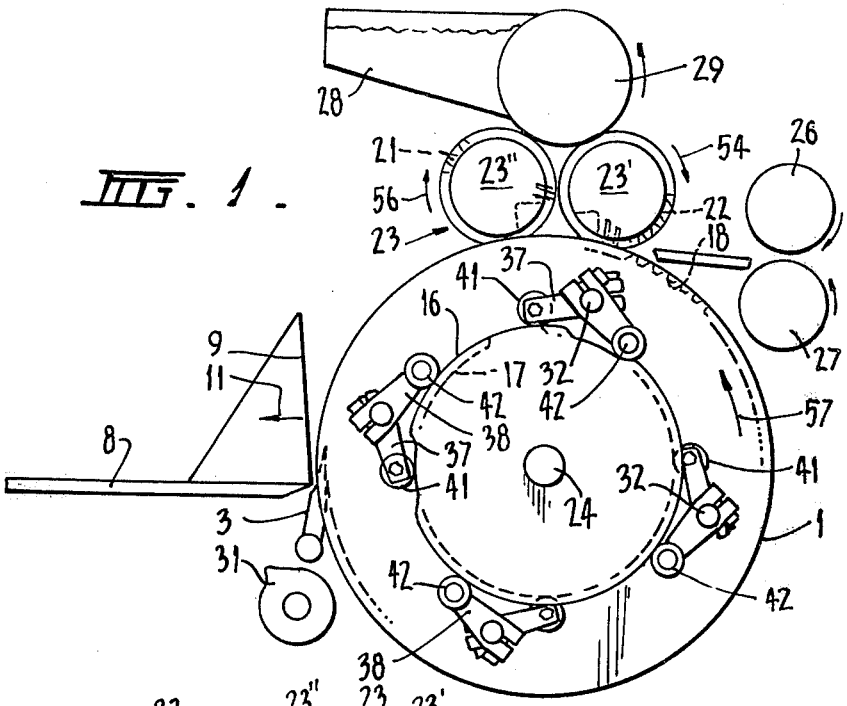
FIG. 1 is a side elevation of a bag making apparatus.
Figure 2:
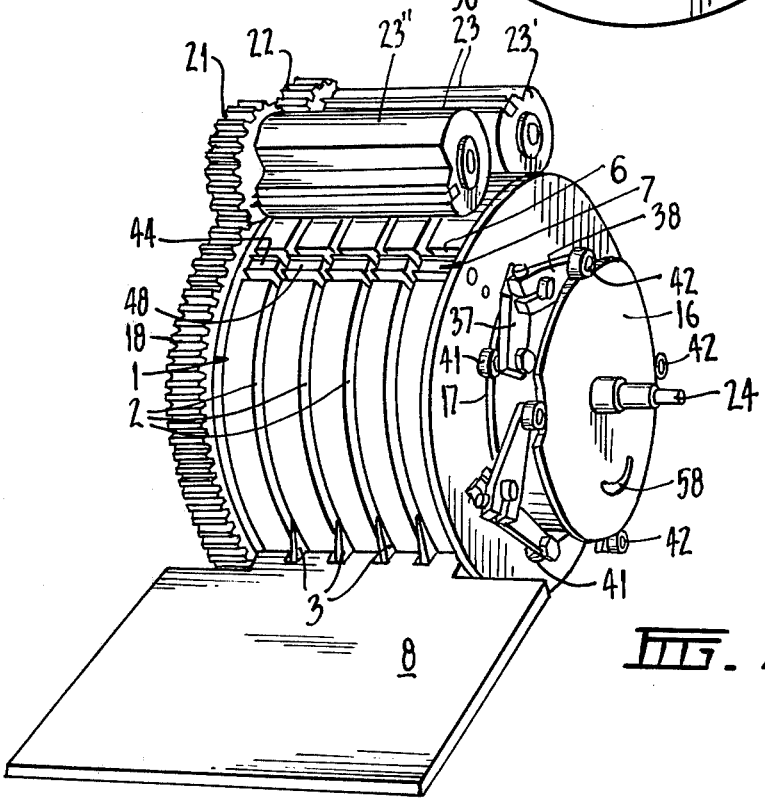
FIG. 2 is a perspective view of the apparatus.

The apparatus shown in FIGS. 1—4 of the drawings comprises a drum 1 having peripheral grooves 2 in which are disposed lifting fingers 3 which are secured to a fixed frame (not shown).

The drum 1 also has longitudinal slots 6 in which four gripping apparati indicated generally by 7 is disposed.

The apparatus further includes a receiving table 8, a pressure plate 9 (not shown in FIG. 2) which is moveable on the table 8 in the direction of arrow 11 against biasing means (not shown).

At one end the drum is provided with stationary cams 16 and 17 and at the other end has a gear 18 which meshes with gears 21 and 22 of two pasting and pushing rolls 23. The drum is mounted to rotate about an axle 24.

The apparatus also includes feed rollers 26 and 27, a paste container 28, a transfer roller 29 and a bag counting cam 31.

Each gripping apparatus 7 includes an axle 32 which is able to oscillate and which carries a block 30 which in turn carries two grippers 33 and 34, and arms 37 and 38 provided with cam follower rolls 41 and 42 and an anvil 44 having sides 46 and 47 and a depression 48.

One of the pasting and pushing rolls 23, hereinafter referred to as 23', has a pushing blade 51', a pasting blade 52' and is relieved at 53'. The other of the pasting and pushing rolls, hereinafter referred to as 23'', has a pushing blades 51'', a pasting blades 52'' and is relieved at 53''.

The pasting and pushing rolls 23 rotate in the direction of arrows 54 and 56 at four times the rate of rotation of the drum 1 which rotates in the direction of arrow 57.

An adjustment slot 58 is provided in the cams 16 and 17 to enable their position relative to the fixed frame to be adjusted. This adjustment may be necessary from time to time or for apparatus tuning purposes.

A deflector 59 is provided.

The operation of the apparatus will now be described and this is best understood from FIGS. 3 and 4 and, to a lesser extent, FIG. 1.

Each of the gripping apparati 7 is used to form a bag and thus in one rotation of the drum 1, one revolution of each gripping apparatus 7, four bags will be formed.

The operation will be considered from the point of view of one gripping apparatus 7; the others operate in similar manner.

Firstly, an elongate bag forming material is taken and sides are folded to middle or folded in some other way such as to one side and paste is applied to form a sleeve open at its ends. This sleeve may be cut into discrete lengths by a modification to the above described apparatus but is preferably cut into discrete lengths before reaching the feed rollers.

Such discrete lengths are fed by the feed rollers 26 and 27 to one of the gripping apparati 7.

Figure 3:
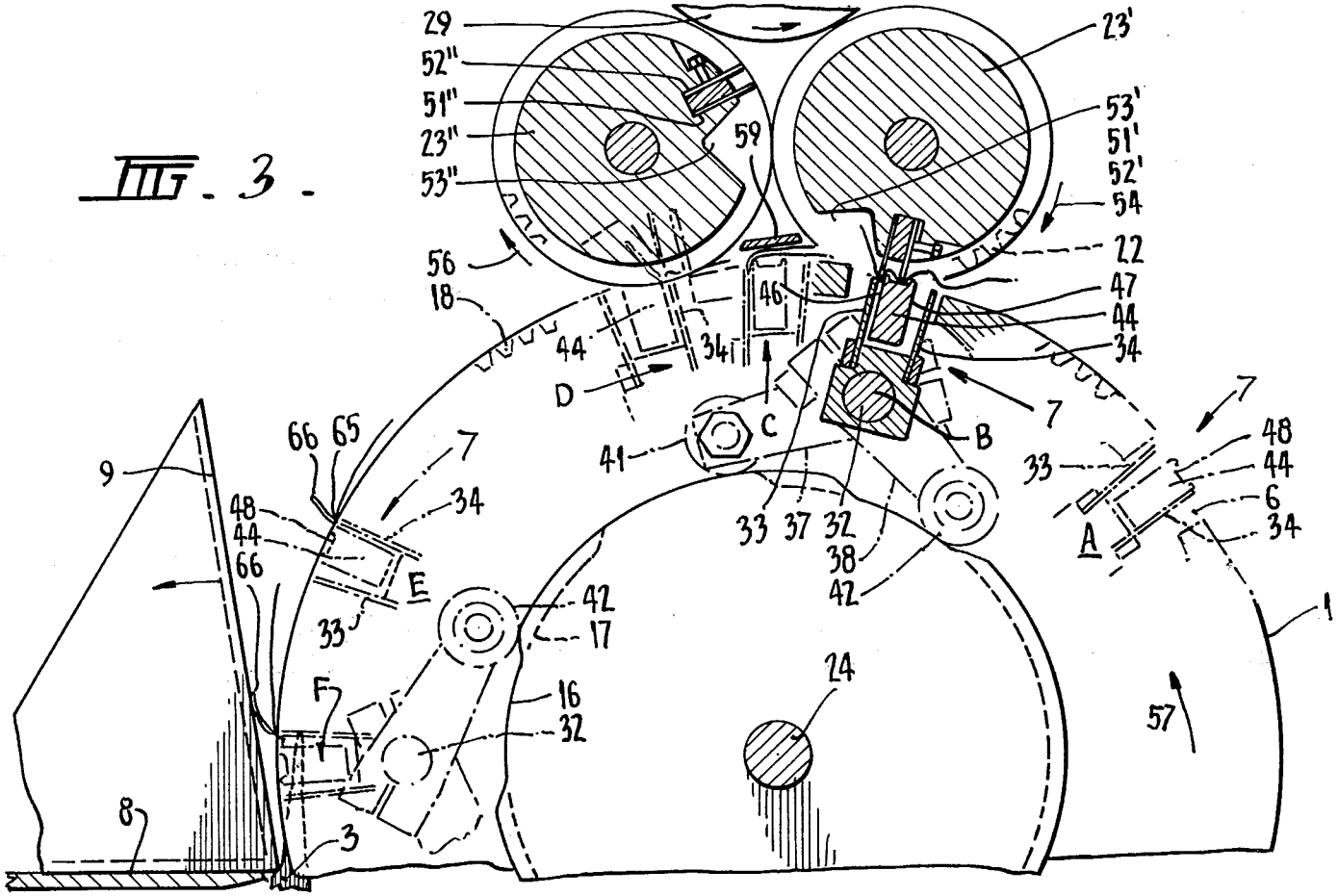
FIG. 3 is a side elevational detail of the apparatus.
Figure 4:
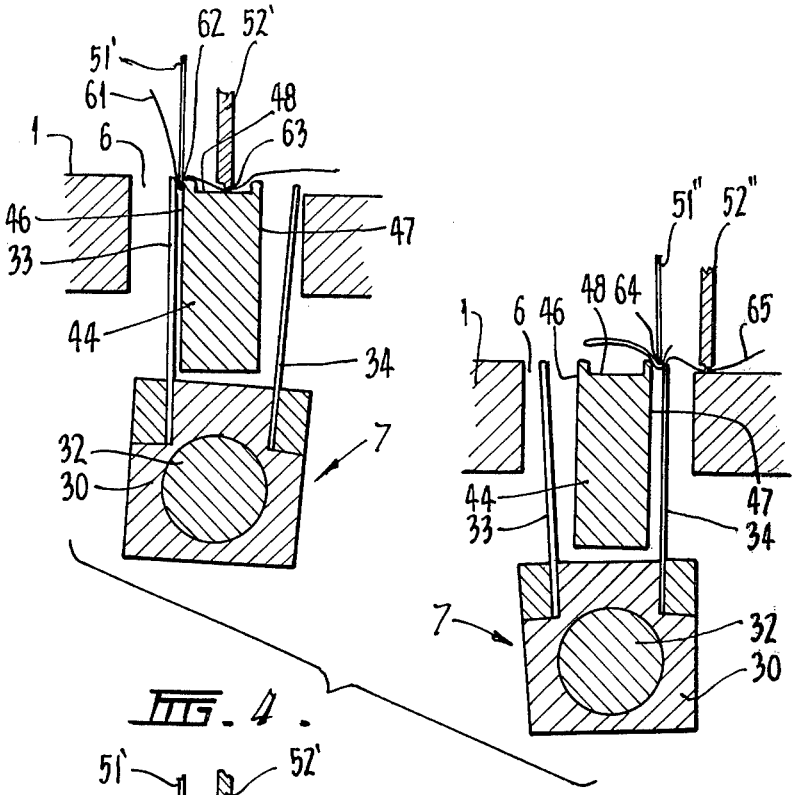
FIG. 4 is a cross-sectional view of part of the apparatus showing two stages in bag making.

The operation of one gripping apparatus 7 will be considered with respect to FIGS. 3 and 4.

As the drum 1 rotates the apparatus 7 comes to the position A shown in FIG. 3 and in consequence of the engagement of the followers 41 and 42 with the cams 16 and 17 the gripper 33 will be spaced from the side 46.

One end, 61, of a discrete length of sleeve is brought to be above the apparatus 7 when it has arrived at the position B in FIG. 3 and in that position the pushing blade 51' causes the distinct length of sleeve at portion 62 to enter between the gripper 33 and side 46 and thereafter engagement of the followers 41 and 42 with the cams 16 and 17 causes the gripper 23 to close on side 46 to grip portion 62. The relief at 53' allows the end 61 to move.

Substantially at the same time the pasting blade 52' which has collected paste from container 28 via roller 29, is applied to the discrete length of sleeve at portion 63 to paste that portion.

The apparatus 7 then passes to the position C shown in FIG. 3 during and after which the end 61 is caused to be deflected by the deflector 59 to overly, in a first fold, the portion 63 and a space which will be observed to exist between gripper 34 and side 47.

The apparatus then passes to the position D shown in FIG. 3 and in so doing the pushing blade 51" causes the discrete length of sleeve at portion 64 to enter that space whereafter engagement of the followers 41 and 42 with cams 16 and 17 cause the gripper 34 to close on side 47 to grip the portion 64 and gripper 33 to move away from side 46. Note that the portion 64 is part of the first fold. The relief at 53" permits movement. The pasting blade 52" applies paste at 65.

Thereafter the apparatus 7 passes through position E to position F and in so doing the portion 66 (FIG. 3) is caused by overly portion 65 by engagement of portion 66 with the plate 9 or with previously produced bags stacked against plate 9.

At position F a bag with two folds has been formed and engagement of the followers 41 and 42 with cams 16 and 17 causes gripper 34 to move away from side 47 to release the bag which will be lifted away from the drum 1 by the fingers 3.

Figure 5:
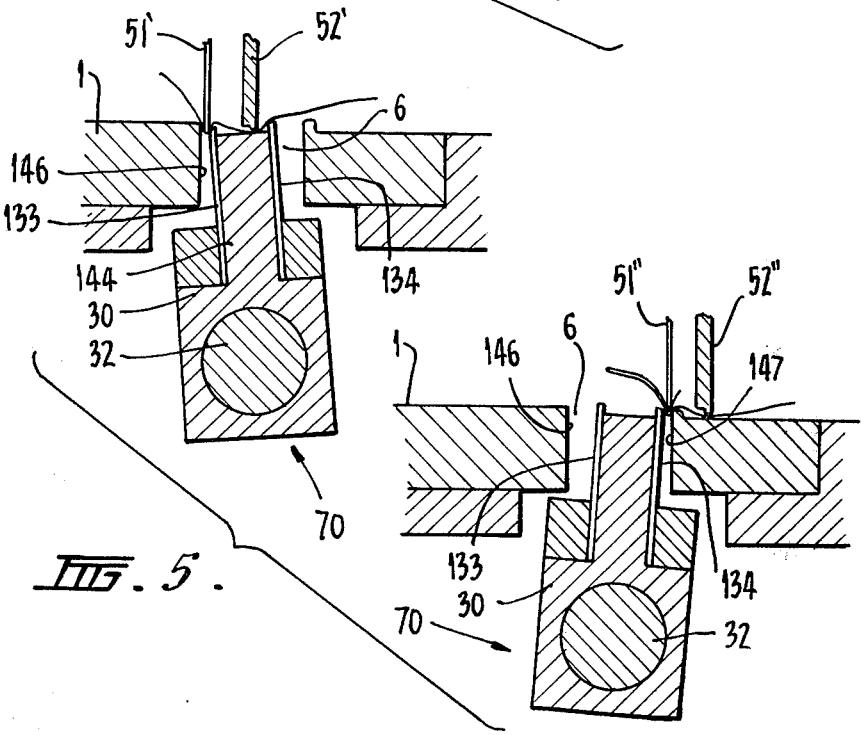
FIG. 5 is a cross-sectional view of part of one alternative apparatus showing two stages in bag making.

The modification shown in FIG. 5 is similar and like numerals denote like parts. However, in this instance gripping apparatus 70 utilizes sides 146 and 147 of the slots 6 to co-operate with grippers 133 and 134 and the anvil 144 is secured to and moves with the block 30.

Figure 6:
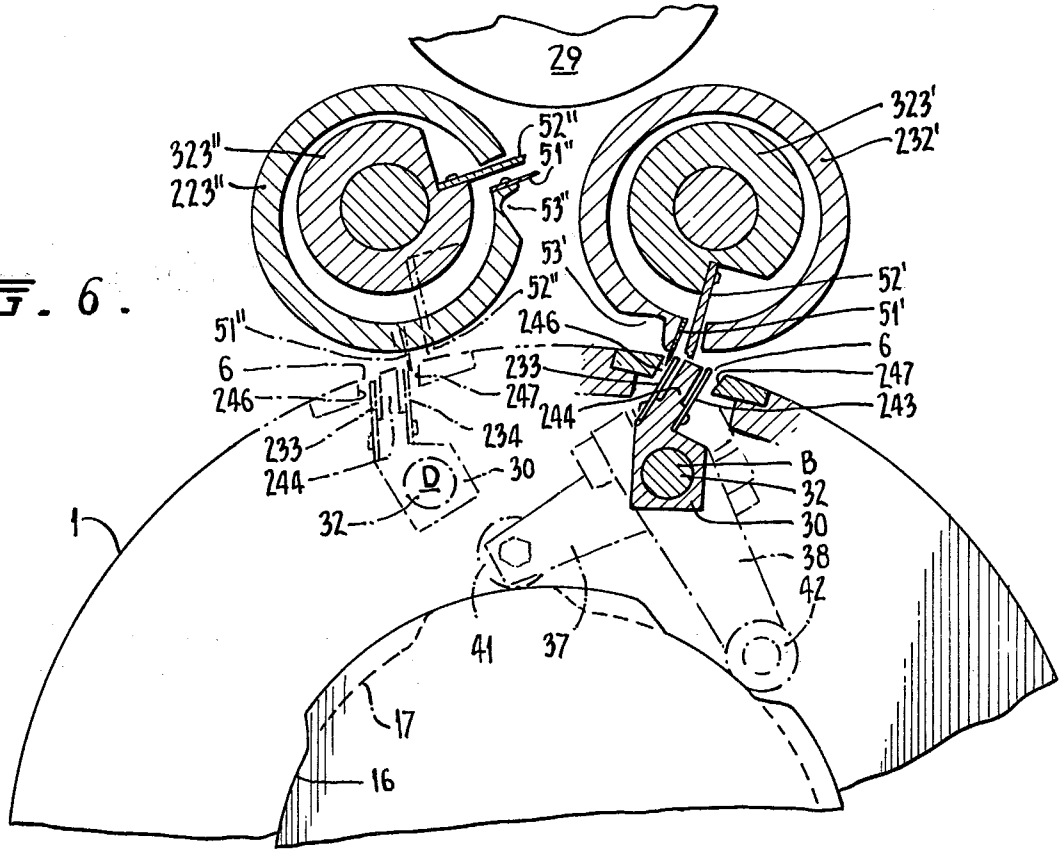
FIG. 6 is a cross-sectional view of part of another alternative apparatus.

The modification shown in FIG. 6 is similar to the construction shown in FIG. 5 and like numerals denote like parts.

However, in this instance an anvil 244 and grippers 233 and 234, which are secured to and move with the block 30 similarly as in FIG. 5, are inclined at an angle of from 5° to 40°, preferably 10° to 30°, more preferably about 20° to normals to the drum 1. The sides 246 and 247 of the slots 6 are similarly inclined. These last features have been found the produce less incorrect feeds.

Further, the grippers 233 and 234 are spaced from the anvil 244 so as to permit resilient bending of the grippers 233 and 234.

Still further, the depression 48, which is also present in FIG. 5 due to the grippers 133 and 134 standing proud of the anvil 144, has been omitted as the presence of this depression tends to produce a curve in the fold region as illustrated in FIGS. 4 and 5. Such a curve results in the formed bags not lying as flat as might be hoped.

The depression 48 did, however, serve a function in that it enabled the pasting blades 52' and 52" to be made radially longer than the pushing blades 51' and 51". Thus, the pushing blades 51' and 51" did not contact the pasting roller 29 wereas the pasting blades 52' and 52" did so. Accordingly, to ensure that the pasting blades 52' and 52" collect paste while the pushing blades 51' and 51" do not collect paste the construction of FIG. 6 utilizes rolls 223' and 223" which rotate about first axes to support the pushing blades 51' and 51" and rolls 323' and 323" which rotate about second axes to support the pasting blades 52' and 52". The respective first and second axes are spaced apart but the respective rolls rotate in synchronism so that, when the pasting blades 52' and 52" and pushing blades 51' and 51" are adjacent the anvils 244, the pushing blades 51' and 51" extend more from the outer surfaces of rolls 223' and 223" than the pasting blades 52' and 52" whereas, when the pasting blades 52' and 52" and pushing blades 51' and 51" are adjacent the pasting roller 29, the pasting blades 52' and 52" extend more from the outer surfaces of rolls 223' and 223" than the pushing blades 51' and 51".

The present invention is particularly suitable for paper bag manufacture but by the use of heat in lieu of paste may be used with thermoplastic materials. In this respect, heat may be applied to one or more of the anvils and "pasting" blades or a radio frequency field may be generated.

Modifications and adaptations may be made to the above described without departing from the spirit and scope of this invention which includes every novel feature and combination of features disclosed herein.

The claims form part of the disclosure of this specification.

I claim:

1. A bag making apparatus comprising:

a frame;

a drum (1) mounted to the frame and adapted to rotate about a first axis (24);

a body (30) mounted to the drum and capable of angular reciprocating movement about a second axis (32) parallel to said first axis, sad body and second axis revolving about said first axis;

a first pair of abutments (33, 46) comprising a first abutment (46) carried by the drum and a second abutment (33) carried by said body;

a second pair of abutments (34, 47) comprising a third abutment (47) carried by the drum and a fourth abutment (34) carried by said body;

means (16, 17, 37, 38, 41, 42) for angularly reciprocating said body about said second axis, as the drum rotates about said first axis, in a first direction, whereby to move said second abutment (33) towards said first abutment (46) and simultaneously to move said third abutment (47) away from said fourth abutment (34) and, in a second, opposite, direction to move said third abutment (47) towards said fourth abutment (34) and simultaneously to move said second abutment (33) away from said first abutment (46), and whereby the abutments of each pair of abutments are co-operable to grip therebetween a part of a sleeve of bag material to be formed into a bag;

means for bonding parts of the sleeve together; and means for deflecting portions of the sleeve when said sleeve is gripped by said abutments;

whereby, in use, a first portion of said sleeve is gripped adjacent one end by said first pair of abutments, said one end is caused to overlie a second portion of said sleeve by said deflecting means to form a bag having a first fold and which first fold being stabilized by parts of the sleeve being bonded to one another by said bonding means, said first pair of abutments move to release said first portion and, simultaneously, said second pair of abutments move to grip a third portion of the sleeve adjacent the end defined by said first fold, and said end defined by said first fold is caused to overlie a fourth portion of the sleeve by said deflecting means to form a second fold and which second fold being stabilized by parts of the sleeve being bonded to one another by said bonding means.

2. A bag making apparatus as claimed in claim 1, wherein said means for bonding parts of the sleeve together includes adhesive applicator means (28, 29, 52).

3. A bag making apparatus as claimed in claim 1, wherein said means for bonding parts of the sleeve together includes heater means for heating parts of the sleeve to melt and thus tackify those parts.

4. A bag making apparatus as claimed in claim 1, wherein said means for angularly reciprocating said body includes cam means (16, 17) secured to the frame, a shaft (32) mounted on said second axis to which said body (30) is mounted and two cam followers (37, 38, 41, 42) mounted to said shaft which contact said cam means (16, 17).

5. A bag making apparatus as claimed in claim 1, wherein the pairs of abutments (233, 246, 234, 247) comprise surfaces lying at an angle of from 10° to 40° to a normal to said drum (1).

6. A bag making apparatus as claimed in claim 1, including means (51) for inserting the relevant portions of said sleeve of bag material between the abutments of the pairs of abutments.

7. A bag making apparatus as claimed in claim 2, including first and second pusher blades (51', 51'') for pushing, respectively, said first bag sleeve portion and said third bag sleeve portion into positions to be gripped by, respectively, said first pair and said second pair of abutments and wherein said adhesive applicator means includes first and second pasting blades (52', 52'') adapted to come into contact with said sleeve to apply adhesive thereto.

8. A bag making apparatus as claimed in claim 7, including means for revolving said pusher blades and said pasting blades about, respectively, third, fourth, fifth and sixth axis in synchronism with the revolution of the pairs of abutments about said first axis.

9. A bag making apparatus as claimed in claim 8, wherein the third and fifth axes are coincident and the fourth and sixth axes are coincident.

10. A bag making apparatus as claimed in claim 8, including at least one surface which, in use, carries paste and with which the pasting blades are brought into contact to, in use, apply paste thereto and wherein the third and fifth axes are spaced and the fourth and sixth axes are spaced such that when the pusher blades and pasting blades are adjacent said at least one surface the pasting blades extend to contact said at least one surface whereas the pusher blades do not contact said at least one surface.

11. A bag making apparatus as claimed in claim 1 wherein said body, said first pair of abutments and said second pair of abutments are replicated at each of at least four angularly spaced positions about the drum whereby the apparatus is capable of making at least four bags per rotation of the drum.

* * * * *